US010284993B2

(12) United States Patent
Buerger et al.

(10) Patent No.: US 10,284,993 B2
(45) Date of Patent: May 7, 2019

(54) APPARATUS AND METHOD FOR DRIVING AN ARRAY OF LOUDSPEAKERS

(71) Applicants: Huawei Technologies Co., Ltd., Shenzhen (CN); FRIEDRICH-ALEXANDER-UNIVERSITAET ERLANGEN-NUERNBERG, Erlangen (DE)

(72) Inventors: Michael Buerger, Erlangen (DE); Heinrich Löllmann, Erlangen (DE); Walter Kellermann, Erlangen (DE); Karim Helwani, Munich (DE); Peter Grosche, Munich (DE); Yue Lang, Beijing (CN)

(73) Assignees: Huawei Technologies Co., Ltd., Shenzhen (CN); FRIEDRICH-ALEXANDER-UNIVERSITAET ERLANGEN-NUERNBERG, Erlangen (DE)

( * ) Notice: Subject to any disclaimer, the term of this patent is extended or adjusted under 35 U.S.C. 154(b) by 0 days.

(21) Appl. No.: 15/722,637

(22) Filed: Oct. 2, 2017

(65) Prior Publication Data

US 2018/0027350 A1 Jan. 25, 2018

Related U.S. Application Data

(63) Continuation of application No. PCT/EP2015/057603, filed on Apr. 8, 2015.

(51) Int. Cl.
*H04S 7/00* (2006.01)
*H04R 5/02* (2006.01)

(52) U.S. Cl.
CPC ..... *H04S 7/302* (2013.01); *H04R 5/02* (2013.01); *H04S 7/30* (2013.01); *H04S 7/301* (2013.01);
(Continued)

(58) Field of Classification Search
None
See application file for complete search history.

(56) References Cited

U.S. PATENT DOCUMENTS

2006/0062395 A1 3/2006 Klayman et al.
2006/0078132 A1* 4/2006 Sako ..... H04R 3/12 381/77
(Continued)

FOREIGN PATENT DOCUMENTS

CN 1426267 A 6/2003
CN 104170408 A 11/2014
(Continued)

OTHER PUBLICATIONS

Jin et al., "Multizone Soundfield Reproduction Using Orthogonal Basis Expansion," IEEE International Conference on Acoustics, Speech and Signal Processing (ICASSP), pp. 311-315, Institute of Electrical and Electronics Engineers, (2013).
(Continued)

*Primary Examiner* — Curtis A Kuntz
*Assistant Examiner* — Qin Zhu
(74) *Attorney, Agent, or Firm* — Leydig, Voit & Mayer, Ltd.

(57) ABSTRACT

A local wave field synthesis apparatus, which includes a determination module for determining desired sound pressures and desired particle velocity vectors at a plurality of control points, a computation module for computing sound pressures and particle velocity vectors at the plurality of control points based on a set of filter parameters, an opti-
(Continued)

mization module for computing an optimum set of filter parameters by jointly optimizing computed sound pressures towards the desired sound pressures and computed particle velocity vectors towards the desired particle velocity vectors, and a generator module for generating the drive signals based on the optimum set of filter parameters, wherein the plurality of control points are located on one or more contours around the one or more audio zones.

19 Claims, 4 Drawing Sheets

(52) U.S. Cl.
CPC .... *H04R 2201/403* (2013.01); *H04R 2499/13* (2013.01); *H04S 2420/13* (2013.01)

(56) References Cited

U.S. PATENT DOCUMENTS

2014/0136981 A1* 5/2014 Xiang ..... H04R 3/005 715/728
2015/0043736 A1* 2/2015 Olsen ..... H04S 7/30 381/17
2017/0034623 A1* 2/2017 Christoph ..... H04R 5/027

FOREIGN PATENT DOCUMENTS

EP 1648198 A2 4/2006
WO 2013135819 A1 9/2013

OTHER PUBLICATIONS

Jin et al., "Multizone Soundfield Reproduction in Reverberant Rooms Using Compressed Sensing Techniques," IEEE International Conference on Acoustics, Speech and Signal Processing (ICASSP), pp. 4728-4732, Institute of Electrical and Electronics Engineers (2014).
Helwani et al., "The synthesis of sound figures," Multidimensional Systems and Signal Processing, Springer, (Published online: Nov. 14, 2013).
Schneider et al.,"A Direct Derivation of Transforms for Wave-Domain Adaptive Filtering Based on Circular Harmonics," 20th European Signal Processing Conference (EUSIPCP 2012), pp. 1034-1038, Bucharest, Romania (Aug. 27-31, 2012).
Shin et al., "Control of Velocity for Sound Field Reproduction," Audio Engineering Society Conference: 52nd International Conference: Sound Field Control—Engineering and Perception, Guildford, United Kingdom (Sep. 2-4, 2013).
Cai et al., "Sound reproduction in personal audio systems using the least-squares approach with acoustic contrast control constraint," The Journal of the Acoustical Society of America, vol. 135, No. 2, pp. 734-741, (2014).
Wu et al., "Spatial Multizone Soundfield Reproduction: Theory and Design," IEEE Transactions on Audio, Speech, and Language Processing, vol. 19, No. 6, pp. 1711-1720, Institute of Electrical and Electronics Engineers, New York, New York (Aug. 2011).
Berkhout et al., "Acoustic control by wave field synthesis," The Journal of the Acoustical Society of America, vol. 93, No. 5, pp. 2764-2778, (May 1993).
Ahrens et al., "Analytical Driving Functions for Higher Order Ambisonics," IEEE International Conference on Acoustics, Speech and Signal Processing (ICASSP), pp. 373-376, Institute of Electrical and Electronics Engineers, (2008).
Poletti, "An Investigation of 2D Multizone Surround Sound Systems," Audio Engineering Society Convention 125, pp. 1-9, Convention Paper 7551, San Francisco, CA, USA (Oct. 2-5, 2008).
Daniel, "Spatial Sound Encoding Including Near Field Effect: Introducing Distance Coding Filters and a Viable, New Ambisonic Format," Audio Engineering Society Conference: 23rd International Conference: Signal Processing in Audio Recording and Reproduction, pp. 1-15, Audio Engineering Society, (2003).
Spors et al., "The Theory of Wave Field Synthesis Revisited," Audio Engineering Society Convention 124, pp. 1-19, Amsterdam, Netherlands (May 2008).
Choi et al., "Generation of an acoustically bright zone with an illuminated region using multiple sources," The Journal of the Acoustical Society of America, vol. 111, No. 4, pp. 1895-1700, (2002).
Shin et al., "Maximization of acoustic energy difference between two spaces," The Journal of the Acoustical Society of America, vol. 128, No. 1, pp. 121-131, (Jul. 2010).

* cited by examiner

APPARATUS AND METHOD FOR DRIVING AN ARRAY OF LOUDSPEAKERS

CROSS-REFERENCE TO RELATED APPLICATIONS

This application is a continuation of International Application No. PCT/EP2015/057603, filed on Apr. 8, 2015, the disclosure of which is hereby incorporated by reference in its entirety.

TECHNICAL FIELD

The present disclosure relates to an apparatus and a method for driving an array of loudspeakers with drive signals to generate one or more local wave fields at one or more audio zones. The present disclosure also relates to a computer-readable storage medium storing program code, the program code comprising instructions for carrying out such a method.

BACKGROUND

The aim of multi-zone sound reproduction is to provide personalized spatial sound to multiple listeners at the same time. In literature, there are different approaches to multi-zone sound reproduction, which can be divided into two main classes: One class is based on the fact that arbitrary sound fields can be expressed by means of spatial basis functions, i.e., plane waves or cylindrical/spherical harmonics. Other specialized basis functions are also possible, which, however, also need to be approximated by fundamental solutions of the acoustic wave equation in order to allow for their physical reproduction via loudspeakers. A prominent example of sound reproduction on the basis of cylindrical/spherical harmonics is referred to as (higher order) ambisonics. In other applications, the terms modal processing or wave-domain processing are used, which essentially exploit the same idea of describing sound fields by means of basis functions. A fundamental drawback of these techniques is that regular geometries of the transducer arrangement are typically required, such as uniformly spaced circular arrays. Furthermore, infinitely long line sources are often used for the analytic description of real 3D wave fields, which requires an additional correction when it comes to the implementation of a physical setup with real loudspeakers arranged on a 2D plane only.

A second class consists of multi-point approaches, where the sound field is optimized at a multitude of so-called control points within a listening area, typically in the least squares sense. In most cases, the sound field is then expressed in terms of impulse responses or transfer functions between the loudspeakers and the control points of interest. This provides an increased flexibility with respect to the transducer setup, and the utilization of measured Room Impulse Responses (RIRs) allows for a straightforward incorporation of the acoustic characteristics of both real loudspeakers and the reproduction environment. The concepts aim for a mere maximization of the sound energy or its difference between two zones (acoustic contrast). A drawback of this approach is that the orientation of the sound intensity cannot be controlled. This problem can be avoided using pressure matching, where the acoustic pressure is optimized rather than its magnitude square (energy). A combination of pressure matching and energy optimization has been suggested, where a constraint is imposed on the sound energy in order to obtain a desired acoustic contrast between the individual listening areas. All of these approaches have in common that the control points are distributed in the entire interior of the local listening areas. This seems impractical for real setups, where the free-field assumption does not hold and physical microphones are utilized as control points. Also, analytical approaches for synthesizing quiet zones have been presented, but the problem of multi-zone sound generation has not yet been solved satisfactorily.

SUMMARY OF THE DISCLOSURE

The objective of the present disclosure is to provide an apparatus and a method for driving an array of loudspeakers with drive signals to generate one or more local wave fields at one or more audio zones, wherein the apparatus and the method overcome one or more of the above-mentioned problems of the prior art.

A first aspect of the disclosure provides a local wave field synthesis apparatus for driving an array of loudspeakers with drive signals to generate one or more local wave fields at one or more audio zones, the apparatus comprising:

- a determination module for determining desired sound pressures and desired particle velocity vectors at a plurality of control points,
- a computation module for computing sound pressures and particle velocity vectors at the plurality of control points based on a set of filter parameters,
- an optimization module for computing an optimum set of filter parameters by jointly optimizing computed sound pressures towards the desired sound pressures and computed particle velocity vectors towards the desired particle velocity vectors, and
- a generator module for generating the drive signals based on the optimum set of filter parameters, wherein the plurality of control points are located on one or more contours around the one or more audio zones.

The apparatus of the first aspect follows up on the concept of pressure matching and aims at a joint optimization of the sound pressures and particle velocity vectors at control points located on contours around the audio zones, which can be seen as local listening areas, rather than within the audio zones. This approach can be understood based on the Kirchhoff-Helmholtz integral, which states that the sound field in a volume is completely determined by the sound field on a surrounding surface.

It is understood that the wave field synthesis apparatus does not need to comprise an amplifier, i.e., the drive signals generated by the wave field synthesis apparatus may need to be amplified by an external amplifier before they are strong enough to directly drive loudspeakers. Also, the drive signals generated by the wave field synthesis apparatus might be digital signals which need to be converted to analog signals and amplified before they are used to drive the loudspeakers.

According to the first aspect, there is not necessarily only one optimum set of filter parameters. In embodiments, there could also be several sets of filter parameters that achieve equally good results, i.e., that are all "optimum" filter parameters.

The determination module can include a digital or analog input through which the wave field synthesis apparatus receives the desired sound pressures and/or the desired particle velocity vectors. In this way, the desired sound pressures and/or the desired particle velocity vectors can be computed by and provided by an outside device. For example, this external device could be a media player, e.g.

a Blu-ray player which is configured to decode a Blu-ray disc with information about locations of virtual sound sources and desired sound pressures.

The desired sound pressures, the desired particle velocity vectors, the computed sound pressures and/or the computed particle velocity vectors can be impulse responses, e.g., they can correspond to a finite impulse at the virtual sound source. As the impulse response can be a function e.g. of the frequency of the signal, it can also be referred to as transfer function.

In embodiments, the desired sound pressures and/or the desired particle velocity vectors are a function of a position and/or an extent of the virtual source. In particular, desired sound pressures and/or the desired particle velocity vectors can be a function of the position of the virtual sound source relative to the control points of an audio zone.

The computation module can be configured to compute sound pressures and/or particle velocity vectors based on assumptions and/or measurements about the virtual sound source, the arrangement of the array of loudspeakers, characteristics of the loudspeakers, objects that are located around or between the loudspeakers, and/or locations and/or postures of humans that are located near the loudspeakers. For example, the locations and/or postures of one or more listeners could be tracked, e.g. with an optical tracking device. Knowledge about the location and/or posture of the listeners could be used in computing the transfer function from the loudspeakers to control points.

The filter parameters can be weights for the loudspeakers, e.g. there can be one weight for each loudspeaker. Furthermore, the weights can be frequency-dependent. For example, there can be one weight for each loudspeaker and for each frequency range. The filter parameters can also be a (analytic or computationally determined) function of the frequency and/or the loudspeakers. Regularization can be used to ensure that similar frequencies correspond to similar filter parameters.

The present disclosure is, among other ideas, based on pressure matching. The aim of pressure matching is to match the reproduced sound pressure at a predefined set of control points with that of a desired target sound field. That is, the aim is to achieve $$H(\omega)w(\omega)\equiv g_{des}(\omega), \tag{1}$$

where $w(\omega)$ and $g_{des}(\omega)$ are column vectors accommodating the loudspeaker prefilters and the acoustic transfer functions from the target source to the control points, respectively. The transfer functions from the loudspeakers to the control points are captured by matrix $H(\omega)$. For the typically encountered overdetermined systems, equation (1) can be approximately solved by a least-squares solution for $w(\omega)$. In the prior art, control points, at which the sound pressure is optimized, are distributed within the interior of the (local) listening area(s). In the simplest case, they are arranged on a dense grid—advanced approaches aim at a more sophisticated distribution. For example, a compressed sensing approach was applied to place the control points in an optimal manner, where the result was an irregular arrangement within the interior of a listening area.

Another prior-art approach would be to control the sound pressure only on a contour around the (local) listening area. This is especially desirable for practical applications, where physical microphones need to be placed at the control points in order to capture the properties of the room. However, according to the Kirchhoff-Helmholtz integral, it is not sufficient to merely optimize for the sound pressure on a contour, but the particle velocity needs to be taken into account, too, in order to fully describe and control the sound field within the contour.

Therefore, the present disclosure provides a system which jointly optimizes for the sound pressure and particle velocity vector (i.e., the sound intensity) on contours around one or more local listening areas. In particular, as detailed below, a system for personalized, multi-zone sound reproduction is proposed, where a desired sound pressure is synthesized within a local listening area ("bright zone"), while the sound intensity in a second (third, fourth, . . . ) local listening area ("dark zone(s)") is minimized. The disclosure also may be implemented for a single local listening area (i.e., no other local listening areas are present).

This can be achieved by simultaneously optimizing the sound pressure and particle velocity vector (i.e., the sound intensity) on the contours around all local listening areas. The desired sound pressure and particle velocity vector on the contour around the bright zone can be determined by the virtual source to be synthesized, whereas the desired sound pressure and particle velocity vector around all dark zones can be required to be equal to zero.

To synthesize individual sound fields in the remaining local listening areas, the process can be repeated for each local listening area, where one of the previously dark zones has now the role of the bright zone and vice versa. The overall sound field for multiple users is then obtained by a superposition of all individual sound field contributions.

In a first implementation of the apparatus according to the first aspect, the determination module is configured to determine the desired sound pressures based on a virtual position of a virtual sound source. In this implementation, the wave field synthesis apparatus can comprise circuitry to compute desired sound pressures based on a position of the virtual sound source relative to the positions of the one or more control points. Known methods of computing desired sound pressures can be used, e.g. in order to achieve certain sound effects at the location of the listener.

In other embodiments, circuitry can be provided that computes the desired sound pressures in addition also based on a relative location of the virtual sound source relative to loudspeakers of the array of loudspeakers. If the apparatus has exact knowledge of the setup of the array of loudspeakers, this has the advantage that the desired sound pressures can be determined more accurately.

In a second implementation of the apparatus according to the first aspect, the determination module is configured to determine the desired particle velocity vectors by computing differences between sound pressures at different control points. This represents an efficient way of computing desired particle velocity vectors in the wave field synthesis apparatus.

In a third implementation of the apparatus according to the first aspect, the optimization module is configured to compute the optimum set of filter parameters separately for different frequencies. As the sound propagation properties typically depend on the frequency of the sound signal, it is preferable to perform the computation of filter parameters separately for different frequencies. For example, the computation can be performed separately for different frequency ranges. In particular, equidistant frequency ranges can be used. Regularization can be used to ensure that this does not result in completely different filter parameters for similar frequencies.

In a fourth implementation of the apparatus according to the first aspect, the optimization module is configured to compute the optimum set of filter parameters by optimizing the cost function $$\min_{w(\omega)}\{\kappa\|H(\omega)w(\omega)-g_{des}(\omega)\|_2^2+(1-\kappa)\|\mathcal{D}(\omega)H(\omega)w(\omega)-v_{des}(\omega)\|_2^2\}$$

wherein w is a vector comprising the set of filter parameters, ω is a frequency, κ is a relative weight with $0 \leq \kappa \leq 1$, H is a matrix comprising transfer functions from the loudspeakers to the control points, $g_{des}$ is a vector indicating the desired sound pressures, $v_{des}$ is a vector indicating the desired particle velocity vectors and $\mathcal{D}$ is a difference matrix. In other words, for each frequency and/or frequency range, a set of filter parameters can be determined that minimizes the above cost function. A difference matrix is a matrix that is used for approximating a derivative based on the method of finite differences. In embodiments, a difference matrix comprises zeros and ones, multiplied with a constant factor that includes an inverse of a distance between the control points, the angular frequency, the density of the propagation medium and/or the imaginary unit.

Experiments have shown that this approach of optimizing the above cost-function represents a particularly efficient and accurate way of computing optimum filter parameters.

In a fifth implementation of the apparatus according to the first aspect, the control points are arranged on the one or more contours in multiple L-shaped groups. In particular, the control points can be arranged in groups of three control points, each group comprising one primary control point and two secondary control points, wherein vectors from the primary control point to the two secondary control points build an angle of 90° between them. This has the advantage that two components of the particle velocity vectors can be computed accurately.

In a sixth implementation of the apparatus according to the first aspect, the apparatus further comprises an input module for receiving input signals from one or more microphones and wherein the computation module is configured for computing the sound pressures and the particle velocity vectors based on one or more transfer functions that are determined based on the input signals. In particular, the one or more microphones can be arranged at and/or near the locations of the control points. Using microphones has the advantage that instead of using theoretical assumptions about the transfer functions, actual measurements which reflect the transfer from the loudspeakers to the control points can be used to obtain a more accurate estimate of the matrix H. In embodiments, one or more of the microphones can be located at the positions of one or more of the control points of the one or more audio zones.

According to a further embodiment of the disclosure, computing and/or estimating the matrix H is based on a combination of a measurement of room impulse responses (e.g. using microphones at one or more control points) and a calculation of room impulse responses, e.g. a calculation based on assumptions about the loudspeakers, dimensions of the room, objects and people in the room, and so on.

In a seventh implementation of the apparatus according to the first aspect, the one or more audio zones comprise one or more bright zones and one or more dark zones, wherein desired sound pressures and/or desired particle velocity vectors at dark zone control points located on one or more contours around the one or more dark zones are zero. This represents a particularly simply and computationally efficient way of computing filter parameters for one or more dark zones.

In an eighth implementation of the apparatus according to the first aspect, the one or more audio zones comprise two or more bright zones, wherein the optimization module is configured to determine an individual optimum set of filter parameters for each of the bright zones and wherein the generator module is configured to generate the drive signals based on the individual optimum sets of filter parameters. In this implementation, drive signals for a plurality of bright zones can be efficiently computed, which allows providing a personalized listening experience to a plurality of listeners.

In a ninth implementation of the apparatus according to the first aspect, the one or more audio zones comprise a circle-shaped audio zone and wherein the one or more contours comprise an inner circle and an outer circle around the circle-shaped audio-zone. Arranging the control points in inner and outer circles has the advantage that pressure differences between the control points on the inner and the outer circle can be used to compute the radial component of a particle velocity vectors. Typically, the radial component corresponds to the component of the particle velocity vector that points toward the center of the audio zone. Preferably, the control points can be arranged in equidistant spacing on the inner circle and on the outer circle. In particular, for each control point on the inner circle there can be a corresponding control point on the outer circle.

In a tenth implementation of the apparatus according to the first aspect, the plurality of control points comprises a first and a second set of control points distributed on the outer circle, wherein the control points of the second set are located at a predetermined distance from the control points of the first set and/or wherein the plurality of control points further comprises a third set of control points distributed on the inner circle, wherein in particular the first, second and third sets of control points comprise a same number of control points. In this arrangement, radial and tangential components of the particle velocity vectors can be computed efficiently and with high accuracy.

A second aspect of the disclosure refers to a method for driving an array of loudspeakers with drive signals to generate one or more local wave fields at one or more audio zones, the method comprising the steps:

- determining desired sound pressures at a plurality of control points,
- determining desired particle velocity vectors at the plurality of control points based on the desired sound pressures,
- computing sound pressures and particle velocity vectors at the plurality of control points based on a set of filter parameters,
- jointly optimizing computed sound pressures and computed particle velocity vectors by varying the set of filter parameters to determine an optimum set of filter parameters, and
- generating the drive signals based on the optimum set of filter parameters, wherein the plurality of control points are located on one or more contours around the one or more audio zones.

It is understood that the above-described implementations of the apparatus of the first aspect are applicable in the same way to the method of the second aspect.

In a first implementation of the method of the second aspect, the desired particle velocity vectors are determined by multiplying a difference matrix with a vector of the desired sound pressures. This is based on the method of finite differences for estimating a derivative.

In a second implementation of the method of the second aspect, the loudspeakers are arranged in a car, wherein in particular determining the desired sound pressures, determining the desired particle velocity vectors and/or computing the sound pressures and particle velocity vectors is based on a model of a passenger compartment of the car. In a car, it can be especially important that e.g. the driver is not distracted from music, whereas the further passengers would like to enjoy music. Applying the method of the second aspect in a car furthermore has the advantage that the positions of the loudspeakers and/or the one or more listeners are known or can be estimated with high accuracy. For example, the position of a listener, in particular the location of the head of a listener can be predicted with high accuracy simply by knowing which seat he or she is occupying. Which seats are occupied can be determined e.g. by detecting which seat belts are in use.

A third aspect of the disclosure refers to a computer-readable storage medium storing program code, the program code comprising instructions for carrying out the method of the second aspect or one of the implementations of the second aspect.

BRIEF DESCRIPTION OF THE DRAWINGS

To illustrate the technical features of embodiments of the present disclosure more clearly, the accompanying drawings provided for describing the embodiments are introduced briefly in the following. The accompanying drawings in the following description are merely some embodiments of the present disclosure, but modifications on these embodiments are possible without departing from the scope of the present disclosure as defined in the claims.

DETAILED DESCRIPTION OF THE EMBODIMENTS

Figure 1:
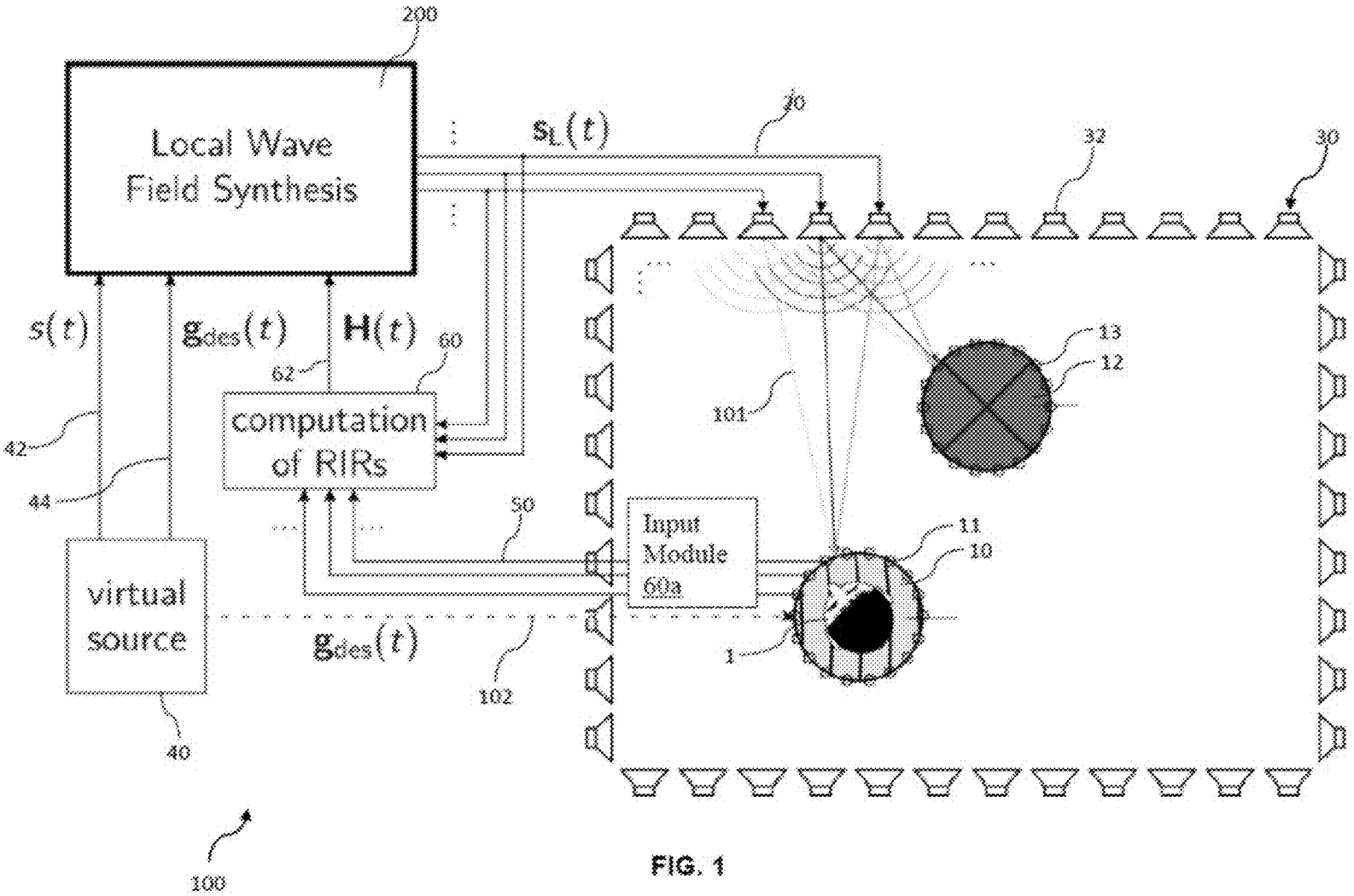
FIG. 1 shows an overview block diagram of a multiple audio zone sound reproduction system which includes a local wave field synthesis apparatus according to an embodiment of the disclosure.

FIG. 1 shows an overview block diagram of a multizone sound reproduction system 100 that comprises a local wave field synthesis apparatus 200 in accordance with the present disclosure. The system is configured to generate a perceived high loudness at a bright zone 10 and a perceived silence or low loudness at a dark zone 12. For example, the bright zone could be located at the position of a listener 1 who wants to listen to music. The position of the listener could be tracked, e.g. with an optical tracking system (not shown in FIG. 1). The location of the audio zone can be periodically or continuously updated based on the detected position of the listener. The dark zone 12 can be located at the position of a second person (not shown in FIG. 1), who does not want to listen to the music. The position of the second person can also be tracked and the location of the dark zone be updated accordingly.

A first plurality of control points 11 are located at a contour of the bright zone 10. A second plurality of control points 13 are located at a contour of the dark zone 12.

Arrows 101 from the loudspeakers to the first and second plurality of control points 11, 13 indicate the transfer function from loudspeaker to control point that is captured in the transfer function matrix H (see below). Dashed arrow 102 from the virtual source unit 40 (which may be a unit of a determination module) to one of the control points 11 of the bright audio zone 10 indicates that the impulse responses 44 that are captured in transfer function vector $g_{des}(\omega)$ correspond to the impulse response at one of the control points that is caused by a finite impulse signal at the virtual source 40. The line 102 is shown as dashed line because this only reflects a desired transfer from virtual source 40 to the control points 11 of the bright zone. There is no actual physical acoustical or physical signal transfer occurring directly from the virtual source 40 to the control points 11.

The lines 50 from some of the control points 11 to the unit for computation of room impulse responses 60 (which may be a unit of a computation module) indicate a direct feedback from control points to this unit. For example, microphones (not shown in FIG. 1) at the locations of the control points 11 can be used to derive the actual acoustic impulse responses 62 that are captured in transfer function matrix H(t). In such embodiments, input module **60*a* can receive the input signals from the one or more microphones. The actual acoustic impulse responses 62 are communicated to the wave field synthesis apparatus 200**.

In the example shown in FIG. 1, loudspeakers 32 are arranged as a rectangular array 30 and are driven by driving signals 20. FIG. 1 shows that the driving signals 20 generated by the wave field synthesis apparatus directly drive the loudspeakers 32, however, it is understood that the wave field synthesis apparatus embodiments include embodiments the do not comprise an amplifier, but would generate driving signals which first need to be amplified before they can be fed to the loudspeakers. In other embodiments, the wave field synthesis apparatus can output digital signals that need to be D/A-converted before they can be used to drive loudspeakers.

The virtual sound source signal to be synthesized for the bright zone 12 can be characterized by its source signal 42 and the desired (acoustic) impulse responses 44, captured in transfer function vector $g_{des}(\omega)$ from the virtual source 40 to control points 11 surrounding the bright zone 10. In other words, the desired impulse responses can be determined based on a virtual position and a virtual extent of the sound source relative to the control points.

The transfer function matrix H(t) captures the actual (acoustic) impulse responses 62 from all loudspeakers 32 to all control points 11, 13. Loudspeaker prefilters, captured in vector w, are computed based on matrix H. Together with a source signal 42, captured in a scalar function s(t), the loudspeaker driving signals 20, captured in vector $s_L(t)$, are determined. The impulse responses 62 in matrix H(t) reflect physical properties that affect how an impulse at the loudspeakers arrives at the control points. The impulse responses 62 in matrix H(t) are either known or can be estimated by a separate algorithm.

Figure 2:
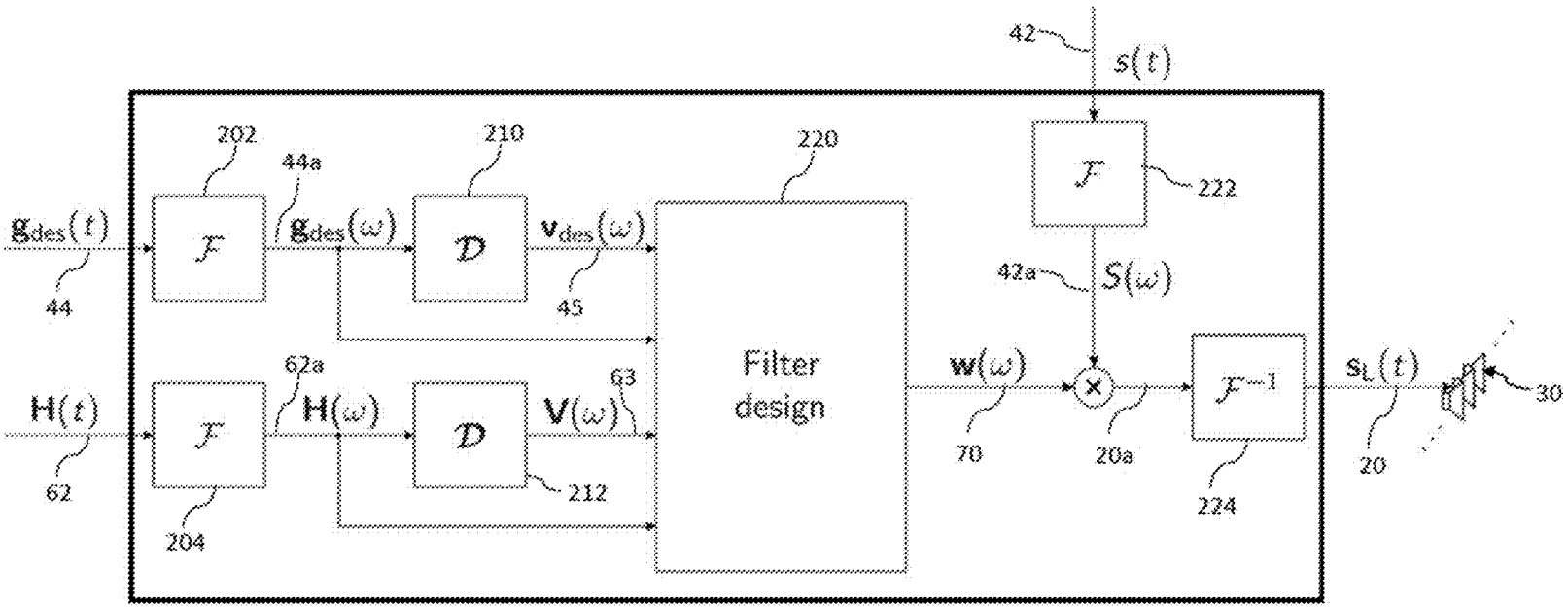
FIG. 2 shows a schematic illustration of the internal structure of the wave field synthesis apparatus of FIG. 1.

FIG. 2 illustrates the structure of the wave field synthesis apparatus 200 of FIG. 1. The desired impulse responses 44 at the control points of the bright zone and the impulse response functions 62 from the loudspeakers to the entirety of the control points are transformed by the first and second Fast Fourier transform units 202, 204 into frequency domain impulse responses 44*a*, 62*a*, captured in frequency domain transfer function vector $g_{des}(\omega)$ and frequency domain transfer function matrix $H(\omega)$, with $\omega$ denoting the angular frequency. They are fed into a processing stage, where the transfer functions with respect to the particle velocity are approximated. This is achieved by approximating the spatial derivative of the sound pressure (which is proportional to the particle velocity) by difference quotients, e.g., along radial and tangential directions on the contours around the local listening areas. Accordingly, the transfer functions with respect to the particle velocity can be approximated by computing differences between transfer functions in $H(\omega)$, which is achieved by multiplying the "difference matrix" $\mathcal{D}(\omega)$ with $g_{des}(\omega)$ or $H(\omega)$. In the difference matrix computation units 210 (which may be a unit of the determination module), 212 (which may be a unit of the computation module), the difference matrix is computed and multiplied with the frequency domain impulse responses 44*a*, 62*a* in order to yield frequency domain desired particle velocity transfer functions 45, captured in the desired frequency domain particle velocity transfer function vector $v_{des}(\omega)$ and the particle velocity vector transfer function 63, captured in matrix $V(\omega)$, which is actually obtained by the reproduction system.

The frequency domain transfer function vector $g_{des}(\omega)$ for the desired sound pressure, the frequency domain transfer function matrix $H(\omega)$ of the reproduction system, the desired frequency domain particle velocity vector transfer function vector $v_{des}(\omega)$, and the frequency domain particle velocity vector transfer function matrix $V(\omega)$ of the reproduction system are then fed into a filter design unit 220 (an optimization module). In the filter design unit, the sound pressure and particle velocity vector on the contours around multiple local listening areas are then jointly optimized by minimizing the cost function $$\min_{w(\omega)}\{\kappa\|H(\omega)w(\omega)-g_{des}(\omega)\|_2^2+(1-\kappa)\|\mathcal{D}(\omega)H(\omega)w(\omega)-v_{des}(\omega)\|_2^2\}, \tag{2}$$

where $0\leq\kappa\leq1$ adjusts the relative weight of the sound pressure and particle velocity vector in the optimization process. The resulting frequency domain loudspeaker prefilters 70, captured in vector $w(\omega)$, are then multiplied with the spectrum 42*a* of the source signal such that a fast convolution is realized. The spectrum $S(\omega)$, captured in $S(\omega)$, is obtained as output from a third Fast Fourier transform unit 222, which obtains the source signal 42, captured in scalar source signal function s(t), as input.

Multiplying the spectrum 42 with the frequency domain loudspeaker prefilters 70 yields the spectra 20*a* of the driving signals. Finally, an inverse FFT in the inverse Fast Fourier transform unit 224 (which may be a unit of a generator module) provides the loudspeaker signals 20, captured in vector $s_L(t)$, for a particular bright zone.

The optimization in Eq. (2) can be performed for each virtual source and each bright zone independently, and the resulting loudspeaker signals obtained for each bright zone are superimposed.

Figure 3:
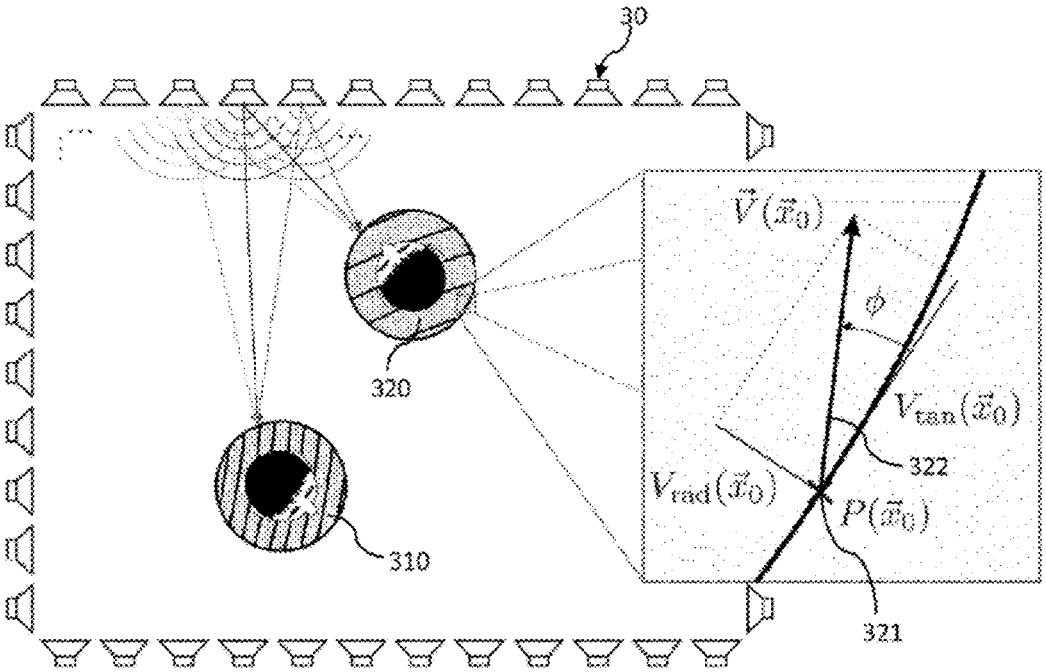
FIG. 3 shows an array of loudspeakers, a bright zone, a dark zone and an schematic illustration of an exemplary definition of the components of the particle velocity vector.

FIG. 3 shows an array of loudspeakers 30, a bright zone 310, a dark zone 320 and a schematic illustration of a particle velocity vector 322. The particle velocity vector 322 reflects the particle velocity at a control point P at location $\vec{x}_0$. The control point P is denoted with reference number 321 in FIG. 3.

The particle velocity vector 322 can, e.g., be defined along radial and tangential directions on the contours around the local listening areas, as shown in FIG. 3. In other words, the particle velocity vector 322 comprises a tangential component $V_{tan}(\vec{x}_0)$ and a radial component $V_{rad}(\vec{x}_0)$. The angle $\phi$ denotes the angular deviation between the direction of the particle velocity vector and a tangential direction along the contour of the respective audio zone.

Figure 4:
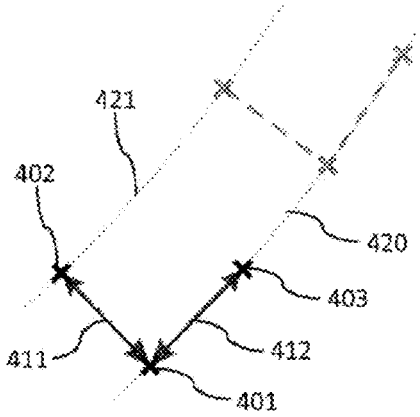
FIG. 4 shows a schematic illustration of control points that are arranged in two L-shaped groups around a (local) audio zone.

In this example, the control points are arranged on the contours in multiple L-shaped groups, as indicated by FIG. 4, where alternative arrangements are also possible.

FIG. 4 illustrates the arrangement of control points in groups of L-shaped groups. A primary control point 401 is arranged on an outer circle 420 around an audio zone (not shown in FIG. 4). Next to the primary control point 401 are a first secondary control point 402, which is located on an inner circle 421 around the audio zone, and a second secondary control point 403, which is located on the outer circle 420 around the audio zone. The first and the second secondary control point 402, 403 are located at the same distance from the primary control point 401. A first vector 411 from the primary control point 401 to the first secondary control point 402 and a second vector 412 from the primary control point 401 to the second secondary control point 403 are at an angle of 90° relative to each other.

For the exemplary realization of the system with one bright and one dark zone, as shown in FIG. 3, and control points arranged according to FIG. 4, the matrix capturing the transfer functions from the loudspeakers to the control points is composed as $$H(\omega)=\begin{bmatrix} H(\vec{x}^B_{out,1}\mid\vec{x}^L_1,\omega) & \dots & H(\vec{x}^B_{out,1}\mid\vec{x}^L_{N_L},\omega)\\ \vdots & \ddots & \vdots\\ H(\vec{x}^B_{out,M}\mid\vec{x}^L_1,\omega) & \dots & H(\vec{x}^B_{out,M}\mid\vec{x}^L_{N_L},\omega)\\ H(\vec{x}^B_{in,1}\mid\vec{x}^L_1,\omega) & \dots & H(\vec{x}^B_{in,1}\mid\vec{x}^L_{N_L},\omega)\\ \vdots & \ddots & \vdots\\ H(\vec{x}^B_{in,N}\mid\vec{x}^L_1,\omega) & \dots & H(\vec{x}^B_{in,N}\mid\vec{x}^L_{N_L},\omega)\\ H(\vec{x}^D_{out,1}\mid\vec{x}^L_1,\omega) & \dots & H(\vec{x}^D_{out,1}\mid\vec{x}^L_{N_L},\omega)\\ \vdots & \ddots & \vdots\\ H(\vec{x}^D_{out,M}\mid\vec{x}^L_1,\omega) & \dots & H(\vec{x}^D_{out,M}\mid\vec{x}^L_{N_L},\omega)\\ H(\vec{x}^D_{in,1}\mid\vec{x}^L_1,\omega) & \dots & H(\vec{x}^D_{in,1}\mid\vec{x}^L_{N_L},\omega)\\ \vdots & \ddots & \vdots\\ H(\vec{x}^D_{in,N}\mid\vec{x}^L_1,\omega) & \dots & H(\vec{x}^D_{in,N}\mid\vec{x}^L_{N_L},\omega) \end{bmatrix}, \tag{3}$$

where the superscripts $^B$ and $^D$ indicate the bright audio zone 310 and the dark audio zone 320, respectively. $\vec{x}_{in,n}$ denotes the position of the n-th control point on the inner circle around the local listening area, with n=1, . . . , N, and N is the number of control points on the inner circle. $\vec{x}_{out,m}$ denotes the position of the m-th control point on the outer circle around the local listening area, with n=1, . . . , M, and M is the number of control points on the outer circle (here: M=2N). The positions of the loudspeakers are denoted as $\vec{x}_l^L$, with l=1, . . . , $N_L$ and $N_L$ being the number of loudspeakers. Then, the difference matrix $\mathcal{D}(\omega)$ is given by $$\mathcal{D}(\omega) = -\frac{1}{j\omega\rho\Delta x}\begin{bmatrix} D & 0_{N\times N} & 0_{N\times M} & 0_{N\times N} \\ -I & I_{N\times N} & 0_{N\times M} & 0_{N\times N} \\ 0_{N\times M} & 0_{N\times N} & D & 0_{N\times N} \\ 0_{N\times M} & 0_{N\times N} & -I & I_{N\times N} \end{bmatrix}, \quad (4)$$

bright zone dark zone where $\rho$ denotes the density of the propagation medium (typically: air), $\Delta x$ is the distance between the control points (see FIG. 4), and j is the imaginary unit. Zero and identity matrices are denoted as 0 and I, respectively, where the subscripts indicate the dimensions on the matrices. Furthermore, we introduce the unit vectors $e_i$ of dimensions N×1 in order to define $D=[-e_1, e_1, -e_2, e_2, \ldots, -e_N, e_N]$ and $I=[e_1, 0_{N\times 1}, e_2, 0_{N\times 1}, \ldots e_N, 0_{N\times 1}]$.

Finally, the loudspeaker prefilters are computed by solving Equation (2) using the regularized pseudoinverse with regularization parameter β, which results in $$w_{opt}(\omega)=(\tilde{H}^H(\omega)\tilde{H}(\omega)+\beta I_{N_L})^{-1}\tilde{H}^H(\omega)\tilde{h}_{des}(\omega), \quad (5)$$

where $$\tilde{H}(\omega) = \begin{bmatrix} \kappa I_{6N\times N} \\ (1-\kappa)\mathcal{D}(\omega) \end{bmatrix} H(\omega) \text{ and } \tilde{h}_{des}(\omega) = \begin{bmatrix} \kappa g_{des}(\omega) \\ (1-\kappa)v_{des}(\omega) \end{bmatrix} H(\omega),$$

and the superscript $^H$ denotes complex conjugate transposition.

Note that the number of dark zones can be extended from one, as given in the example above, to an arbitrary number by expanding the matrices $\mathcal{D}(\omega)$, $H(\omega)$, $\tilde{H}(\omega)$, $\tilde{h}_{des}(\omega)$, $g_{des}(\omega)$, and $v_{des}(\omega)$ accordingly.

Figure 5:
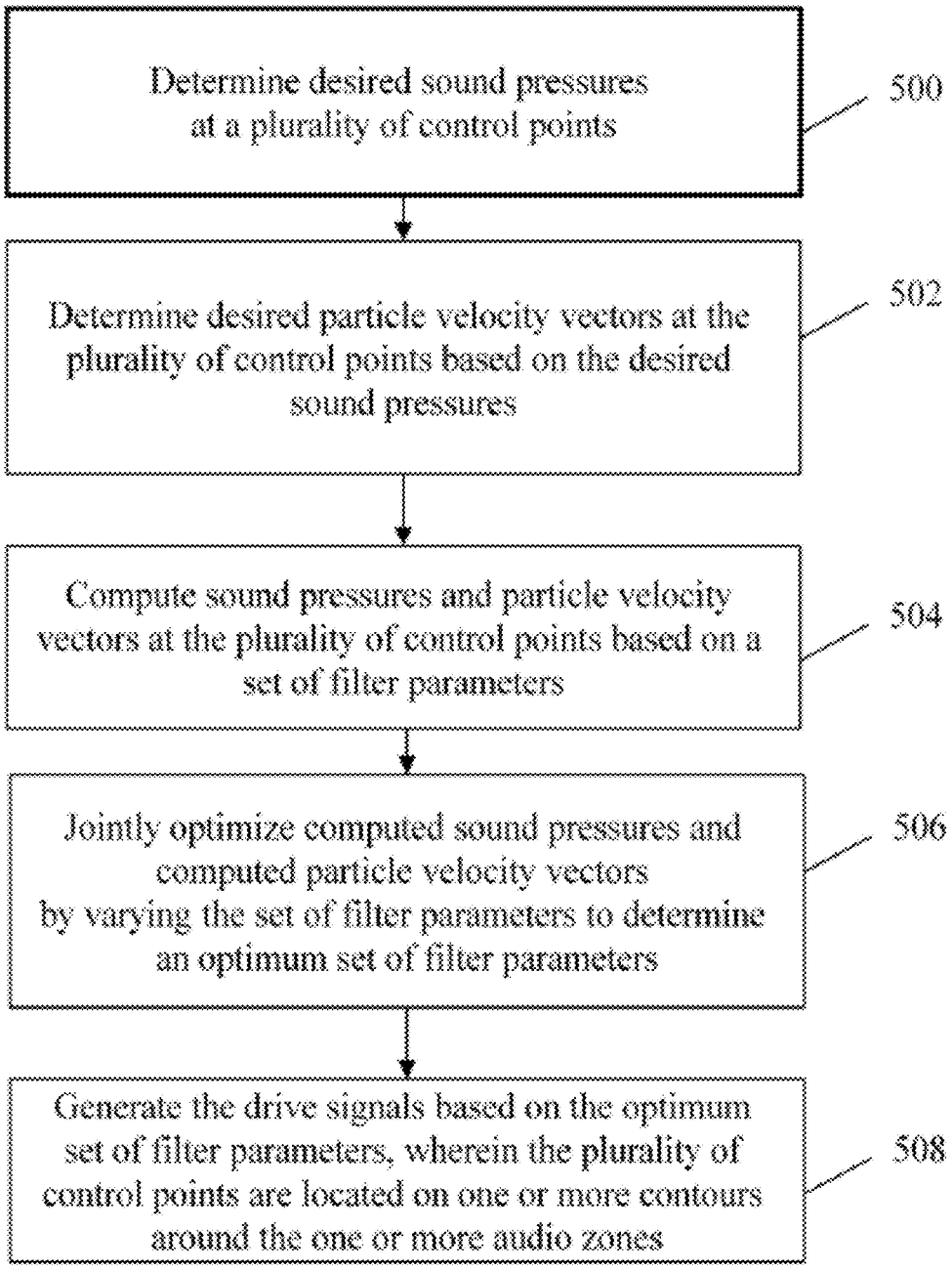
FIG. 5 shows a diagram of a method for driving an array of loudspeakers with drive signals to generate one or more local wave fields at one or more audio zones according to an embodiment.

FIG. 5 shows a diagram of a method for driving an array of loudspeakers with drive signals to generate one or more local wave fields at one or more audio zones according to an embodiment. At step 500, desired sound pressures at a plurality of control points are determined.

At step 502, desired particle velocity vectors at the plurality of control points based on the desired sound pressures are determined. The desired particle velocity vectors can be determined by multiplying a difference matrix with a vector of the desired sound pressures.

At step 504, sound pressures and particle velocity vectors at the plurality of control points based on a set of filter parameters are computed. At step 506, the computed sound pressures and computed particle velocity vectors are jointly optimized by varying the set of filter parameters to determine an optimum set of filter parameters. At step 508, the drive signals based on the optimum set of filter parameters are generated, wherein the plurality of control points are located on one or more contours around the one or more audio zones.

The above-described method may be applied in an automobile setting such as loudspeakers that are arranged in a car. For example, step 502 may determine the desired particle velocity vectors and/or step 504 may compute the sound pressures and particle velocity vectors based on a model of a passenger compartment of the car.

Regarding further details of the individual steps, it is also referred to the elaborations regarding FIGS. 1 to 4.

To summarize, a system and method for personalized, multi-zone sound reproduction is proposed. It is based on the joint optimization of the sound pressure and particle velocity vector (i.e., the sound intensity) on contours around multiple or a single local listening area(s). As a result, multiple individual, local sound fields can be generated in different areas of the reproduction space, which allows for personalized audio. The system is flexible with respect to the loudspeaker geometry, and measured room impulse responses can be easily incorporated in order to compensate for the non-ideal characteristics of real loudspeakers and the reproduction room (e.g., reverberation).

The disclosure has been described in conjunction with various embodiments herein. However, other variations to the disclosed embodiments can be understood and effected by those skilled in the art in practicing the claimed disclosure, from a study of the drawings, the disclosure and the appended claims. In the claims, the word "comprising" does not exclude other elements or steps and the indefinite article "a" or "an" does not exclude a plurality. A single processor or other unit may fulfil the functions of several items recited in the claims. The mere fact that certain measures are recited in usually different dependent claims does not indicate that a combination of these measures cannot be used to advantage.

Embodiments of the disclosure may be implemented in a computer program for running on a computer system, at least including code portions for performing steps of a method according to the disclosure when run on a programmable apparatus, such as a computer system or enabling a programmable apparatus to perform functions of a device or system according to the disclosure.

A computer program is a list of instructions such as a particular application program and/or an operating system. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system.

The computer program may be stored internally on computer readable storage medium or transmitted to the computer system via a computer readable transmission medium. All or some of the computer program may be provided on transitory or non-transitory computer readable media permanently, removably or remotely coupled to an information processing system. The computer readable media may include, for example and without limitation, any number of the following: magnetic storage media including disk and tape storage media; optical storage media such as compact disk media (e.g., CD-ROM, CD-R, etc.) and digital video disk storage media; nonvolatile memory storage media including semiconductor-based memory units such as FLASH memory, EEPROM, EPROM, ROM; ferromagnetic digital memories; MRAM; volatile storage media including registers, buffers or caches, main memory, RAM, etc.; and data transmission media including computer networks, point-to-point telecommunication equipment, and carrier wave transmission media, just to name a few.

A computer process typically includes an executing (running) program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

The computer system may for instance include at least one processing unit, associated memory and a number of input/output (I/O) devices. When executing the computer program, the computer system processes information according to the computer program and produces resultant output information via I/O devices.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality. For example, local wave field synthesis apparatus 200 may include units 40, 60 and 60*a*.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, the examples, or portions thereof, may implemented as soft or code representations of physical circuitry or of logical representations convertible into physical circuitry, such as in a hardware description language of any appropriate type.

Also, the disclosure is not limited to physical devices or units implemented in nonprogrammable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

What is claimed is:

1. A local wave field synthesis apparatus for driving an array of loudspeakers with drive signals to generate one or more local wave fields at one or more audio zones, the apparatus comprising:

a memory storing program codes; and a processor configured to execute the program codes to cause the apparatus to:

determine desired sound pressures and desired particle velocity vectors at a plurality of control points, wherein the plurality of control points are located on one or more contours around the one or more audio zones, compute sound pressures and particle velocity vectors at the plurality of control points based on a set of filter parameters, compute an optimum set of filter parameters by jointly optimizing the computed sound pressures towards the desired sound pressures and the computed particle velocity vectors towards the desired particle velocity vectors, wherein computing the optimum set of filter parameters is based on optimizing a cost function:

$$\min_{w(\omega)}\{\kappa\|H(\omega)w(\omega)-g_{des}(\omega)\|_2^2+(1-\kappa)\|\mathcal{D}(\omega)H(\omega)w(\omega)-v_{des}(\omega)\|_2^2\},$$

wherein w is a vector comprising the set of filter parameters, ω is a frequency, κ is a relative weight with $0\leq\kappa\leq1$, H is a matrix comprising transfer functions from the loudspeakers to the control points, $g_{des}$ is a vector indicating the desired sound pressures, $v_{des}$ is a vector indicating the desired particle velocity vectors, and $\mathcal{D}$ is a difference matrix; and generate the drive signals based on the optimum set of filter parameters.

2. The apparatus of claim 1, wherein determining the desired sound pressures is based on a virtual position of a virtual sound source.

3. The apparatus of claim 1, wherein determining the desired particle velocity vectors is based on computing differences between sound pressures at different control points of the plurality of control points.

4. The apparatus of claim 1, wherein computing the optimum set of filter parameters comprises computing the optimum set of filter parameters separately for different frequencies.

5. The apparatus of claim 1, wherein the control points are arranged on the one or more contours in multiple L-shaped groups.

6. The apparatus of claim 1, wherein the processor is further configured to receive input signals from one or more microphones, and compute the sound pressures and the particle velocity vectors based on one or more transfer functions that are determined based on the input signals.

7. The apparatus of claim 1, wherein the one or more audio zones comprise one or more bright zones and one or more dark zones, wherein desired sound pressures and/or desired particle velocity vectors at dark zone control points located on one or more contours around the one or more dark zones are zero.

8. The apparatus of claim 1, wherein the one or more audio zones comprise two or more bright zones, wherein determining the optimum set of filter parameters comprises determining an individual optimum set of filter parameters for each of the two or more bright zones, and wherein generating the drive signals is based on the individual optimum sets of filter parameters.

9. The apparatus of claim 1, wherein the one or more audio zones comprise a circle-shaped audio zone, and wherein the one or more contours comprise an inner circle and an outer circle around the circle-shaped audio-zone.

10. The apparatus of claim 9, wherein the plurality of control points comprises a first and a second set of control points distributed on the outer circle, wherein the control points of the second set are located at a predetermined distance from the control points of the first set.

11. The apparatus of claim 10, wherein the plurality of control points further comprises a third set of control points distributed on the inner circle, wherein the first, second, and third sets of control points comprise a same number of control points.

12. A method for driving an array of loudspeakers with drive signals to generate one or more local wave fields at one or more audio zones, the method comprising:

determining desired sound pressures and desired particle velocity vectors at a plurality of control points, wherein the plurality of control points are located on one or more contours around the one or more audio zones, wherein the plurality of control points are arranged on the one or more contours in multiple L-shaped groups;

computing sound pressures and particle velocity vectors at the plurality of control points based on a set of filter parameters;

computing an optimum set of filter parameters by jointly optimizing the computed sound pressures towards the desired sound pressures and the computed particle velocity vectors towards the desired particle velocity vectors; and generating the drive signals based on the optimum set of filter parameters.

13. The method of claim 12, wherein the desired particle velocity vectors are determined by multiplying a difference matrix with a vector of the desired sound pressures.

14. The method of claim 13, wherein the loudspeakers are arranged in a car, wherein determining the desired sound pressures is based on a model of a passenger compartment of the car.

15. The method of claim 13, wherein the loudspeakers are arranged in a car, wherein determining the desired particle velocity vectors is based on a model of a passenger compartment of the car.

16. The method of claim 13, wherein the loudspeakers are arranged in a car, wherein computing the sound pressures and particle velocity vectors is based on a model of a passenger compartment of the car.

17. A non-transitory computer-readable storage medium storing program code that, when executed by a processor, causes a computing apparatus to perform the steps of:

determining desired sound pressures and desired particle velocity vectors at a plurality of control points, wherein the plurality of control points are located on one or more contours around the one or more audio zones, wherein the one or more audio zones comprise a circle-shaped audio zone, and wherein the one or more contours comprise an inner circle and an outer circle around the circle-shaped audio-zone;

computing sound pressures and particle velocity vectors at the plurality of control points based on a set of filter parameters;

computing an optimum set of filter parameters by jointly optimizing the computed sound pressures towards the desired sound pressures and the computed particle velocity vectors towards the desired particle velocity vectors; and generating the drive signals based on the optimum set of filter parameters.

18. The computer-readable storage medium of claim 17, wherein the plurality of control points comprises a first and a second set of control points distributed on the outer circle, wherein the control points of the second set are located at a predetermined distance from the control points of the first set.

19. The computer-readable storage medium of claim 18, wherein the plurality of control points further comprises a third set of control points distributed on the inner circle, wherein the first, second, and third sets of control points comprise a same number of control points.

* * * * *